United States Patent [19]

Müller et al.

[11] 4,331,101

[45] May 25, 1982

[54] ELECTROGRAPHIC COPYING DEVICE WITH MAGNETIC CYLINDER

[75] Inventors: Werner Müller, Bonn-Bad Godesburg; Erich A. Steingroever, Bonn, both of Fed. Rep. of Germany

[73] Assignee: Magnetfabrik Bonn GmbH, Bonn am Rhein, Fed. Rep. of Germany

[21] Appl. No.: 150,552

[22] Filed: May 16, 1980

[30] Foreign Application Priority Data

May 25, 1979 [DE] Fed. Rep. of Germany ..... 2921229

[51] Int. Cl.[3] ..... G03G 15/09

[52] U.S. Cl. ..... 118/658; 427/34

[58] Field of Search ..... 118/657, 658; 427/34

[56] References Cited

U.S. PATENT DOCUMENTS 4,237,819 12/1980 Ikegami et al. ..... 118/658

*Primary Examiner*—Bernard D. Pianalto

*Attorney, Agent, or Firm*—Fisher, Christen & Sabol

[57] ABSTRACT

The magnetic field which is required to hold image-forming toner particles on the tubular carrier of electrographic copiers is provided by single piece integrally formed permanent magnet bodies extending from end to end of the tubular carrier, the latter comprising a thin layer of ferromagnetic material to reduce the effect on inhomogeneities which may exist in the magnet bodies.

13 Claims, 5 Drawing Figures

ELECTROGRAPHIC COPYING DEVICE WITH MAGNETIC CYLINDER

CROSS-REFERENCE TO RELATED APPLICATION

This application relates to apparatus of the type disclosed and claimed in the prior application of Werner Müller, Ser. No. 969,889, filed Dec. 15, 1978 and assigned to the assignee of this application.

BACKGROUND OF THE INVENTION

Toner carrier tubes conventionally consist of a diamagnetic material which is to be rotated about an internally situated magnetic cylinder provided with several magnetic pole pieces with axially aligned pole surfaces, situated adjacent to each other in the axial direction. The toner carrier tube, together with the magnetic cylinder, is used for the feeding of a magnetically attractable toner powder from a powder container onto a latent electrostatic image produced on a suitable support material.

In the case of magnetic cylinders it is already known to use a magnetic core that consists of several similar axially aligned adjacent permanent magnetic pole pieces with axially alilgned pole faces with a material having high magnetic permeability between at least one of the axially aligned pole faces and the toner carrier tube. In a preferred embodiment, over at least one of the axially aligned pole faces of the magnetic cylinder a strip of ferromagnetic material is attached with the width of the strip being no greater than the width of the pole face. Here it is also possible to arrange the stips of material having a high magnetic permeability not on the magnetic core but in or on a tube of diamagnetic material that is inserted between the magnetic core and the toner carrier tube and is aligned in such a way that the strips of magnetically permeable material are arranged exactly above the axially aligned pole faces on which the tube is fastened to the magnetic core or to the shaft of the magnetic cylinder.

In order to eliminate the difficulties that are associated with the construction of the magnetic poles from axially adjacent permanent-magnetic pole pieces, it has been suggested in said application Ser. No. 969,889 that the toner carrier tube have a ferromagnetic material of such a thickness or of such magnetic quality that there appears a homogenization of the magnetic field but such that the latter is only partially shunted.

This results in the advantage that no additional strips of material need be fastened to the pole faces of the magnetic cylinder. Rather it is sufficient to design the toner carrier tube so that the discontinuities of the magnetic field of the magnetic cylinder stemming from the transitions between the pole pieces be compensated for by the material of the toner carrier tube in order, in this way, to achieve a uniform and strip-free feeding of the toner powder for the development of the latent electrostatic image.

SUMMARY OF THE INVENTION

The object of this invention is to improve the copying properties of electrographic copying devices having magnetic cylinders with the aid of such a toner carrier tube.

In accordance with this invention this is accomplished by the utilization in the magnetic cylinders of single-piece magnetic strips of a permanent-magnetic material extending over their entire length and distributed over their periphery.

The inventors have established that the copying effect with such cylinders turns out to be expectedly good and uniform. Not only are the inhomogeneities of the individual magnets of the prior application Ser. No. 969,889 reduced, but the field distribution of the single full-length magnets is improved.

The single-piece magnetic strips in such magnetic cylinder preferably consist of a plastic-bonded isotropic or anisotropic barium ferrite material, the production of which is well known in the art.

In one embodiment of the invention the toner carrier tube can consist of a thin iron sheet. However it is also possible to construct the toner carrier tube of a diagrammatic or nonmagnetic material, such as aluminum, magnesium, copper, zinc, or of a diamagnetic or nonmagnetic mixed alloy of these metals, such as an aluminum-magnesium alloy, brass, or a high-grade zinc alloy, of stainless steel, or of plastic and to equip it with a thin coating of a ferromagnetic material. The tube here can either be plated with a thin coating of soft-iron material. But it can also have a flame-sprayed coating with ferromagnetic properties, such as iron-aluminum powder, for example, on a light-metal support. The iron-aluminum coating can consist of 10 to 90% by weight iron powder, preferably 40 to 60% by weight iron powder, the remainder being aluminum powder.

However, the toner carrier tube can also have a galvanic coating of ferromagnetic material, such as nickel, on a brass carrier tube. Instead of this, however, it can also be coated on either the inside or the outside of the tube with a paint containing iron powder.

The ferromagnetic material usefully has a thickness of about 0.1 to 1 mm, preferably about 0.4 to 0.6 mm.

In all embodiments of the invention the coatings of ferromagnetic material can be applied both to the outside and to the inside of the toner carrier tube.

DESCRIPTION OF THE PREFERRED EMBODIMENT OF THE INVENTION

Figure 1:
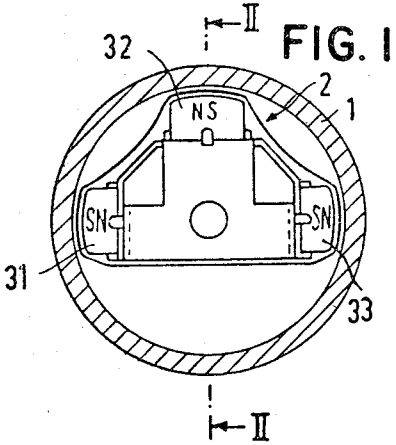
FIG. 1 is a transverse cross-section of a preferred form of toner carrier tube with a magnetic cylinder arranged therein.
Figure 2:
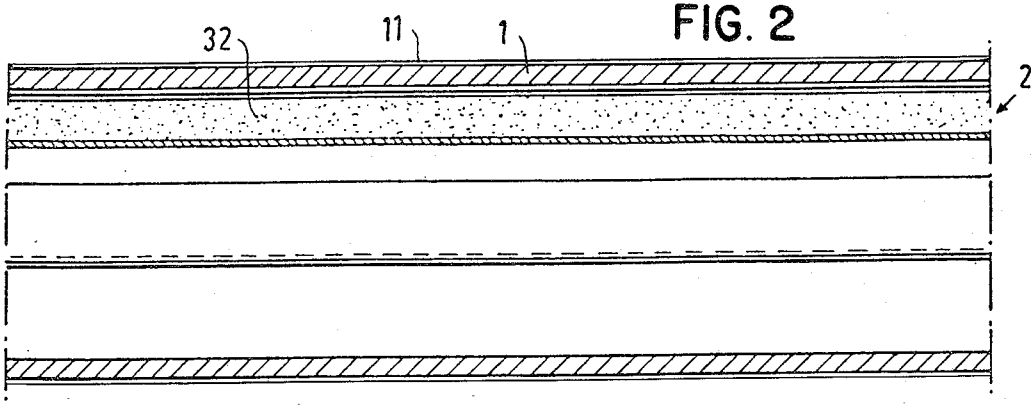
FIG. 2 is a fragmentary longitudinal cross-ssection of the apparatus of FIG. 1, taken on the line II—II.

In the embodiment shown in FIGS. 1 and 2 the toner carrier tube consists of a ferromagnetic material, such as iron sheet for example. A magnetic cylinder 2 arranged in the interior of the carrier tube 1 has several single-piece magnetic strips 31, 32, 33 . . . , which conventionally consist of a plastic-bonded barium ferrite material.

Figure 3:
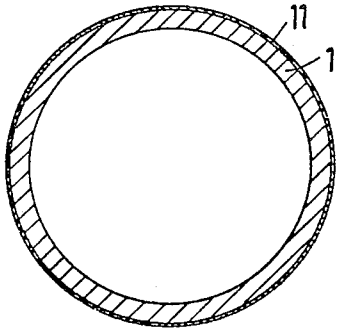
FIG. 3 is a transverse cross-section of a modified form of toner carrier tube only.

In the embodiment shown in FIG. 2 the toner carrier tube 1 consists of a diamagnetic or nonmagnetic material and has a thin coating 11 of a ferromagnetic material that could, alternatively, be deposited on the inside of the tube. Possibilities for the tube material itsself are aluminum, magnesium, copper, zinc, or a nonmagnetic mixed alloy of these metals, such as an aluminum-magnesium alloy, brass, or a high-grade zinc alloy. The tube 1 can consist of stainless steel or plastic and can be plated on the inside or the outside of the tube with a thin coating 11 of soft-iron material as is represented in FIG. 3.

Figure 4:
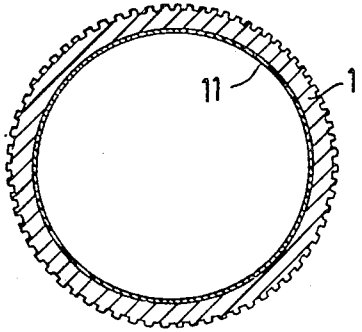
FIG. 4 is a transverse cross-section of a further modification of the toner carrier tube.

In the embodiment shown in FIG. 4 the toner carrier tube 1 is constructed with a surface that is grooved in the direction of the tube axis and on the inside of the tube there is a coating 11 of a paint containing iron powder.

Figure 5:
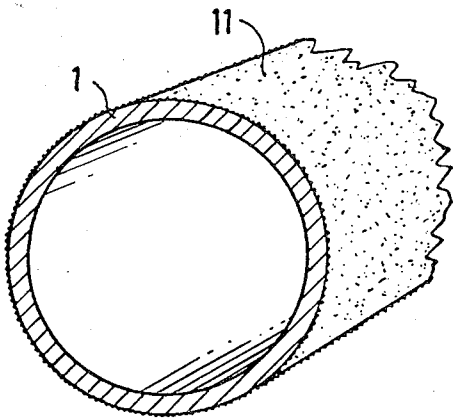
FIG. 5 is a cross-sectional perspective view of a stiff further modified form of toner carrier tube.

In the further embodiment shown in FIG. 5 the toner carrier tube has a flame-sprayed coating 11 with ferromagnetic properties. The flame-sprayed coating can consist, for example, of an iron-aluminum powder on a light-metal support and, as in the other embodiments, can be situated on the inside or the outside of the tube. The iron-aluminum coating consists of 10 to 90% by weight iron powder, the remainder aluminum, where a composition of 40 to 60% by weight iron powder, the remainder aluminum, has been found to be particularly useful.

Instead of a flame-sprayed coating 11 a galvanic coating of ferromagnetic material, such as nickel on a brass carrier tube for example, is also possible.

The ferromagnetic material usually has a thickness of 0.1 to 1 mm and preferably 0.4 to 0.6 mm.

We claim:

1. In electrographic copiers of the type wherein a toner-carrying device comprises a tubular shell of ferromagnetic material which cooperates with an assembly including a permanent magnet body to form images by means of toner particles having high magnetic permeability deposited on said device and the tubular shell comprises ferromagnetic material having a thickness to minimize the inhomogeneities in the magnetic field generated by said permanent magnet body, the improvement wherein said permanent magnet body consists of a single integrally formed body of permanent magnet material extending axially along substantially the entire length of said tubular ferromagnetic shell; and a coaxial tube of diamagnetic or nonmagnetic material to support said ferromagnetic tubular shell.

2. The invention defined in claim 1, wherein said toner-carrying device comprises a thin tube of iron.

3. The invention defined in claim 1, wherein said toner-carrying device comprises a tube of diamagnetic or nonmagnetic material, such as aluminum, magnesium, copper, zinc, stainless steel or plastic, or a diamagnetic or nonmagnetic alloy comprising one or more of said materials, such as aluminum-magnesium alloy, brass or fine zinc alloy, said tube being provided with a layer of ferromagnetic material.

4. The invention defined in claim 3, wherein said layer of ferromagnetic material comprises a thin plating of soft iron.

5. The invention defined in claim 3, wherein said layer of ferromagnetic material comprises a flame-sprayed coating of a material having ferromagnetic properties.

6. The invention defined in claim 5, wherein said tube comprises a light metal support provided with flame-sprayed coating of iron-aluminum powder.

7. The invention defined in claim 3, wherein said layer of ferromagnetic material is electrochemically deposited upon said tube.

8. The invention defined in claim 7, wherein said tube comprises brass provided with an electrochemically deposited coating of nickel.

9. The invention defined in any one of claims 1 through 8, wherein the thickness of the ferromagnetic layer lies approximately within the range of 0.1 to 1.0 mm.

10. The invention defined in any one of claims 1 through 8, wherein the thickness of the ferromagnetic layer lies within the range of 0.4 to 0.6 mm.

11. The invention defined in any one of claims 1 through 8, wherein said permanent magnet body comprises barium ferrite particles bonded together by a plastic composition.

12. The invention defined in claim 11, wherein the thickness of the ferromagnetic material lies approximately within the range of 0.1 to 1.0 mm.

13. The invention defined in claim 11, wherein the thickness of the ferromagnetic material lies approximately within the range of 0.4 to 0.6 mm.

* * * * *